US007973252B2

(12) United States Patent
Anderson

(10) Patent No.: US 7,973,252 B2
(45) Date of Patent: Jul. 5, 2011

(54) IGNITION SWITCH

(75) Inventor: Jean M. Anderson, Coldwater, MI (US)

(73) Assignee: UCOM, Inc., Orland, IN (US)

( * ) Notice: Subject to any disclaimer, the term of this patent is extended or adjusted under 35 U.S.C. 154(b) by 282 days.

(21) Appl. No.: 12/141,447

(22) Filed: Jun. 18, 2008

(65) Prior Publication Data

US 2009/0315394 A1 Dec. 24, 2009

(51) Int. Cl.
*H01H 19/00* (2006.01)

(52) U.S. Cl. ..... 200/19.28; 200/43.08

(58) Field of Classification Search ..... 200/43.03, 200/43.08, 19.28

See application file for complete search history.

(56) References Cited

U.S. PATENT DOCUMENTS 1,684,940 A * 9/1928 Bohlman ..... 200/14
3,299,876 A * 1/1967 Mieras ..... 123/651
4,413,247 A * 11/1983 Hire ..... 337/368

* cited by examiner

*Primary Examiner* — Renee Luebke
*Assistant Examiner* — Lisa Klaus
(74) *Attorney, Agent, or Firm* — Matthew R. Schantz; Bingham McHale LLP

(57) ABSTRACT

A three-position, single-pole, double-throw, rotary ignition switch is disclosed that is water-tight and provides qualitative and quantifiable durability in the presence of high-current loads, even after long use. It withstands a continuous 20 A load, plus an additional occasional 20 A load, when in the "run" position. It withstands an additional 75 A inductive load when in the "start" position. Then even after 12,000 operational cycles, leakage current (with 28 VDC supply voltage) when the switch is in the "off" position, and between non-current-carrying terminals when the switch is in the "on" position, remains under 0.3 mA, and still allows leakage current not exceeding 10 mA at any time while each disconnected pair of terminals and between terminals and ground are exposed to 1,000±5 $V_{rms}$ at a frequency of at least 60 Hz being increased 400 V/sec for one minute.

17 Claims, 6 Drawing Sheets

IGNITION SWITCH

FIELD OF THE INVENTION

The present invention relates to an electrical circuit maker in the form of an ignition switch for a vehicle. More specifically, the present invention relates to a vehicle ignition switch that provides improved durability characteristics for high-current applications.

BACKGROUND

Military units in the United States and other countries have used HMMWVs (High Mobility Multipurpose Wheeled Vehicles) for moderate- to heavy-duty transport activities for decades. Through those decades it has been found that the high currents passing through the ignition switch during operation of the vehicles (and their accessories) have weakened the insulators used in the ignition switches, resulting in short circuits and other current-leakage failures. In many embodiments, substantially all electrical power that is used in or on a vehicle passes through the ignition switch. There is, therefore, a need for an ignition switch that better withstands long-term use, repeated actuation, and high current flow without yielding to these failures.

FIG. 1 illustrates the external form factor of a single-pole double-throw rotary ignition switch 20 used in HMMWV light tactical vehicle (LTV, such as the Joint Light Tactical Vehicle (JLTV) currently being developed by the U.S. military) applications. This technology can also be applied to other vehicles and non-vehicular electrical systems without undue experimentation as will occur to those skilled in the art.

Assembly 22 extends from a main body 24 and provides the point of attachment through which torque is applied via a separate handle (ordnance part number 5381088) to change the state of the switch 20. In this embodiment, stem assembly 22 includes screw 26, washer 28, nut 30, and washer 32. Torque is applied to switch 20 via a separate handle (not shown) to change the state of switch 20 between an "off" position, a "run" position, and a "start" position. Switch 20 is spring-biased to return automatically to the "run" position from the "start" position.

Body 24 has an opening in its end opposite stem assembly 22 that exposes terminals 34, 36, and 38. Terminals 34, 36, and 38 are held within base 40, which provides electrical isolation between the terminals 34, 36, and 38, and between each of them and rubber shell 42. Rubber shell 42 provides additional insulation and facilitates water-tight connection with the terminals.

SUMMARY

Some embodiments of the present invention provide improved durability by using an insulator between ignition switch terminals that does not fatigue, cause carbon tracking, or abrade in the presence of normal frictional forces and with the effects of high-current use in the circuitry of a HMMWV, LTV, or other vehicle. Some of these embodiments provide open-circuit resistance across the insulator with dielectric strength sufficient to withstand 1000 VAC and yield leakage not exceeding 10 mA. These embodiments maintain a leakage current that does not exceed 0.2 mA at 28.0 VDC. Each of these tests applies after 12,000 cycles of operation.

Some embodiments use PLENCO 01581 as an insulating material, which in these embodiments yields tighter tolerances for dielectric strength, leakage current, and endurance testing based on verification methods described herein.

DESCRIPTION

Figure 1:
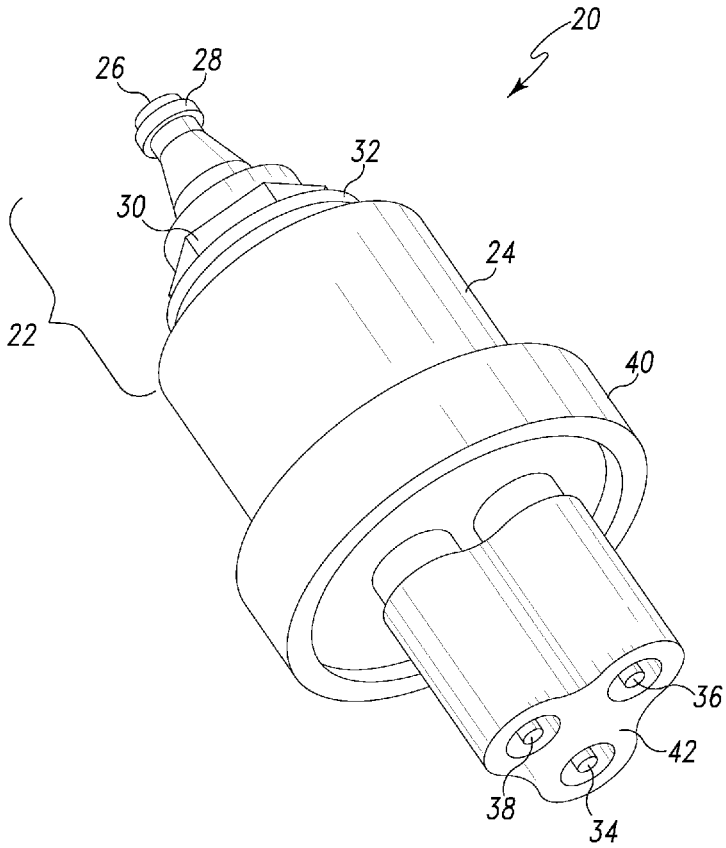
Fig. 1 (Prior Art)
FIG. 1 is a perspective view of an ignition switch for use in a HMMWV.

For the purpose of promoting an understanding of the principles of the present invention, reference will now be made to the embodiment illustrated in the drawings and specific language will be used to describe the same. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Assembly

FIGS. 2-6 illustrate an ignition switch according to one embodiment of the present invention. It is a 28 VDC, waterproof, rotary switch that complies with US Military Standard MIL-DTL-13623 (Type II, Class 1). It also conforms to U.S. Military drawing 12506826. It has three positions, or states, the positions being designated "off," "run," and "start." The "start" position is a momentarily held position, and the switch is biased to return to the "run" position from the "start" position when no torque is externally applied to the switch mechanism.

Three terminals, in accordance with U.S. Army Standard A-A-52536, are provided and are designated "battery," "run," and "start." When the switch is in the "off" position, no internal conductive path is provided between the terminals. When the switch is in the "on" position, current is supplied from the "battery" terminal to the "run" terminal. When the operator moves the switch to the "start" position, current is also supplied from the "battery" terminal to the "start" terminal. Current continues to be supplied to the "run" terminal as the switch moves from the "run" state to the "start" state and back.

The switch is rated to supply a continuous 28 VDC at 20 A to a resistive load on the "run" terminal. The switch is also rated to supply an additional 75 A in surge current to an inductive load on the "start" terminal, and a 20 A "lamp load" of light bulb(s) on either the "start" or "run" terminal (one at a time). When in the "off" position, leakage current through the switch does not exceed 0.2 mA. When in the "run" or "start" position, the voltage drop through electrically connected pairs of terminals does not exceed 75 mV.

Figure 2:
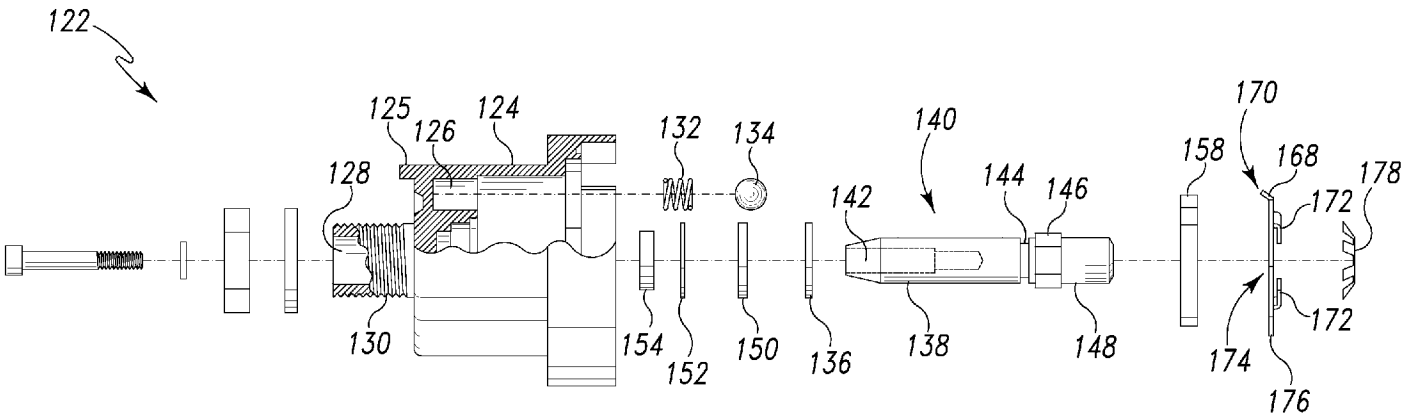
FIG. 2 is an exploded, partial-section elevation view of a housing assembly in an ignition switch according to one embodiment of the present invention. Sub-views 2A, 2B, and 2C are elevation views of retaining washer 150, plate 158, and drive plate 168, respectively.

FIG. 2 shows internal features of a housing assembly for use in an ignition switch according to the present embodiment. Generally, stem 140 extends through housing 124 to provide an external point of access by which torque is applied to the switch mechanism to change its state, such as when a key is turned to put the vehicle in an "on" state, or momentarily in a "start" state. Assembly 122 includes housing 124, which includes recess 126, bore 128, and external threads 130. In this embodiment, location nub 125 helps locate housing 124 in tooling during assembly. Housing 124 is preferably die cast from zinc according to UNS No. Z33520 in accordance with either SAE J468 or ASTM B 86, and is preferably coated in accordance with U.S. Military drawing MIL-P-53084.

Spring 132 is inserted in recess 126, and ball 134 is placed on it. Spring 132 is preferably alloy coating music wire per ASTM A 228. Ball 134 is preferably made of SAE 52100 chrome steel, Grade 200, with a Rockwell C hardness between about 60 and about 67. Ball 134 and the area around it are then lubricated using Dow Corning® 55 O-Ring lubricant grease.

Washer 136 is placed around shaft 138 of stem 140, which also includes bore 142, groove 144, hexagonal feature 146, and head 148 as features. Stem 140 is preferably SAE 72 CDA 360 half-hard free-machining brass having Rockwell B hardness of at least 80 (and more preferably between about 85 and about 89). Stem 140 is plated per US Federal Specification QQ-P-416F, Type I, Class 3, or zinc plated per ASTM B633 FE/ZN 5 SC2 type I.

Retaining washer 150 is placed in groove 144 adjacent to washer 136, and washer 152 is placed adjacent to retaining washer 150. O-ring 154 is dipped into Dow Corning® 55 O-Ring lubricant grease and placed around shaft 138 adjacent to washer 152, and the assembled stem is inserted through bore 128. The assembled stem is staked into housing 124 to provide a water-tight seal.

Figure 2C:
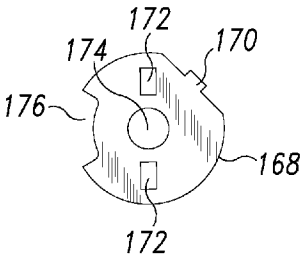
Figure 2B:
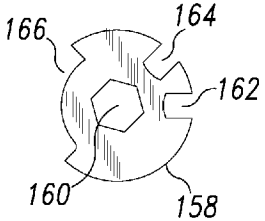
Figure 2A:
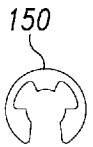
Figure 4:
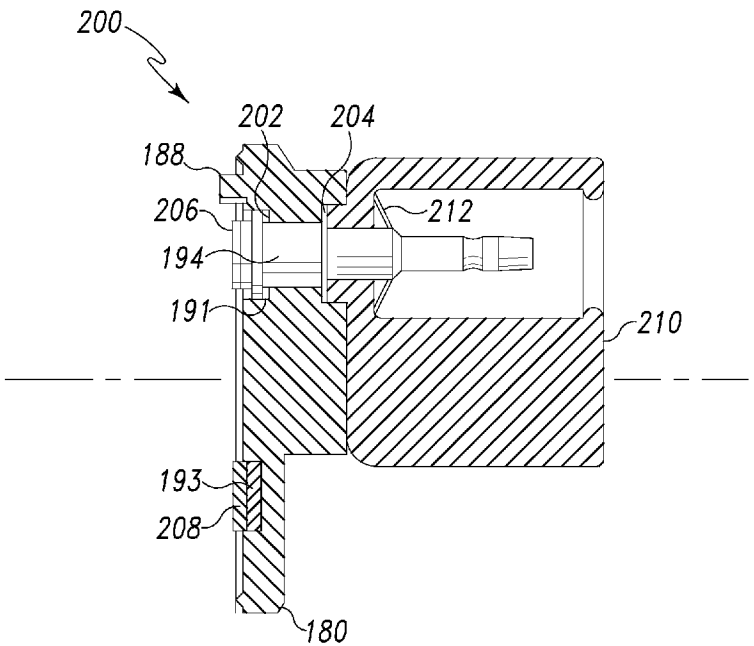
FIG. 4 is a section view of a base-shell assembly for use with the housing assembly shown in FIG. 2.

As illustrated in FIG. 2B, plate 158 includes as features hexagonal through-hole 160, notch 162, notch 164, and wide notch 166. The notches 162 and 164 partially receive ball 134 when the switch is in its "off" and "run" positions, respectively, in order to bias the switch toward retaining those positions.

As illustrated in FIG. 2C, drive plate 168 includes curved tab 170 and tabs 172, center through-hole 174, and wide notch 176 as features. Positioning plate 158 and drive plate 168 are preferably made of steel with cadmium plating per Federal Specification QQ-P-416, class 3, type I, or zinc plating per ASTM B633 FE/ZN 5 SC2 type I, and the steel from which positioning plate 158 is made is preferably case hardened. Drive plate 168 is preferably added to housing assembly 122 so that through-hole 174 fits over head 148 of stem 140, and is held in place there by retainer 178. The assembly is staked in place using a suitable die and press.

Figure 7:
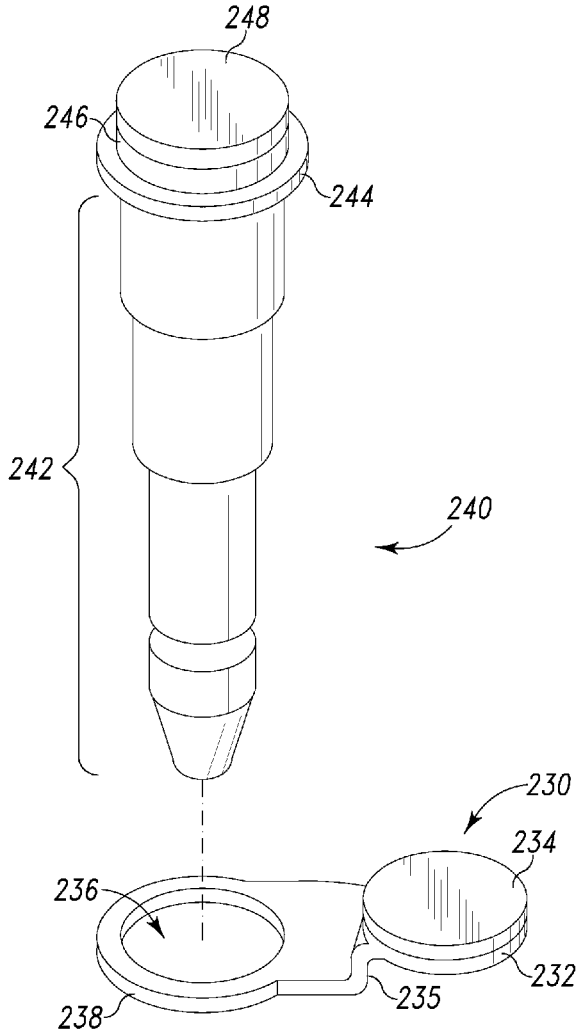
FIG. 7 is an exploded view of a terminal and contact carrier for use in the embodiment of FIGS. 2-6.

FIG. 7 illustrates a contact carrier 230 and terminal 240 that are used in this illustrated embodiment. Contact carrier 230 includes a lower portion 238 and upper portion 232 made of a conductive substance such as brass. Transition portion 235 connects the two. Upper portion 232 supports contact 234. Lower portion 238 defines hole 236 through which terminal 240 is inserted during assembly. Terminal 240 includes stem 242, shoulder 244, contact 248 and a silver brazed layer 246 that connects contact 248 to the rest of terminal 240. Contact 248 is preferably made of 65 Ag 35 WC. During assembly of switch base 200, there are two instances in which terminals 240 are placed through contact carriers 230, and in each case shoulder 244 limits the axial movement of terminal 240 at the point where shoulder 244 meets lower portion 238 of contact carrier 230. This arrangement puts a brazed cap of contact 248 in a substantially even level with contact 234, and hole 236 in contact carrier 230 fits them into appropriate positions relative to other components of switch base 200 (see FIG. 4).

Figure 3:
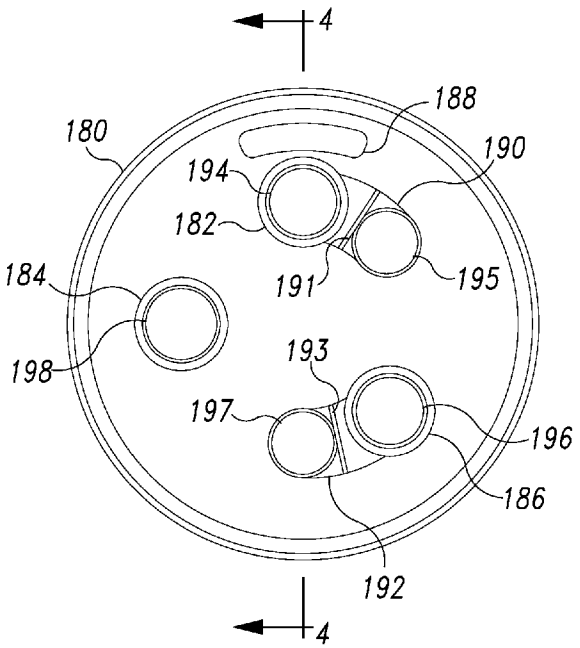
FIG. 3 is an plan view of an insulating base component for use with the housing assembly shown in FIG. 2.

Turning now to FIG. 3, base 180 has as features through-holes 182, 184, and 186, locating feature 188, and contact carrier location depressions 190 and 192. Terminal 198 is placed through through-hole 184 having ledge 202 to assist in positioning the terminal axially. As can be seen with additional reference to FIGS. 4 and 7, contact carriers 191 and 193 are placed into contact carrier location depressions 190 and 192, thereby positioning contact caps 195 and 197 as shown. Terminals 194 and 196 are placed through through-holes 182 and 186 defined by the lower portions of contact carriers 191 and 193. Each terminal 194, 196, and 198 is then shaped mechanically to yield flanges 204, which complete the positioning and hold terminals 194, 196, and 198 substantially rigidly in place with respect to base 180. Each contact on terminals 194, 196, and 198 is preferably made of 65/35 silver/tungsten-carbide alloy.

Insulating shell 210 is placed over the extended points of terminals 194, 196, and 198, and retaining washers 212 are placed over each terminal to keep it in place. Base 180 and shell 210 are staked into place with retainers 212 in another die and press operation. Base 180 in the present embodiment is injection-molded from a polyester molding compound such as Plenco 01581 from the Plastics Engineering Company, Sheboygan, Wis. Plenco 01581 has a CTI (see below) of 600, which is within the preferred range (at least about 200) and more preferred range (at least about 500) of CTI values for insulating materials from which these components are made. Shell 210 is a rubber material per MIL-STD-417 of MIL-R-3065 that passes tests 2BC, 617, A14, C12, E034, F19 and Z1, and a dielectric test (see below) at 1000 VAC with no more than 50 mA present.

Figure 5:
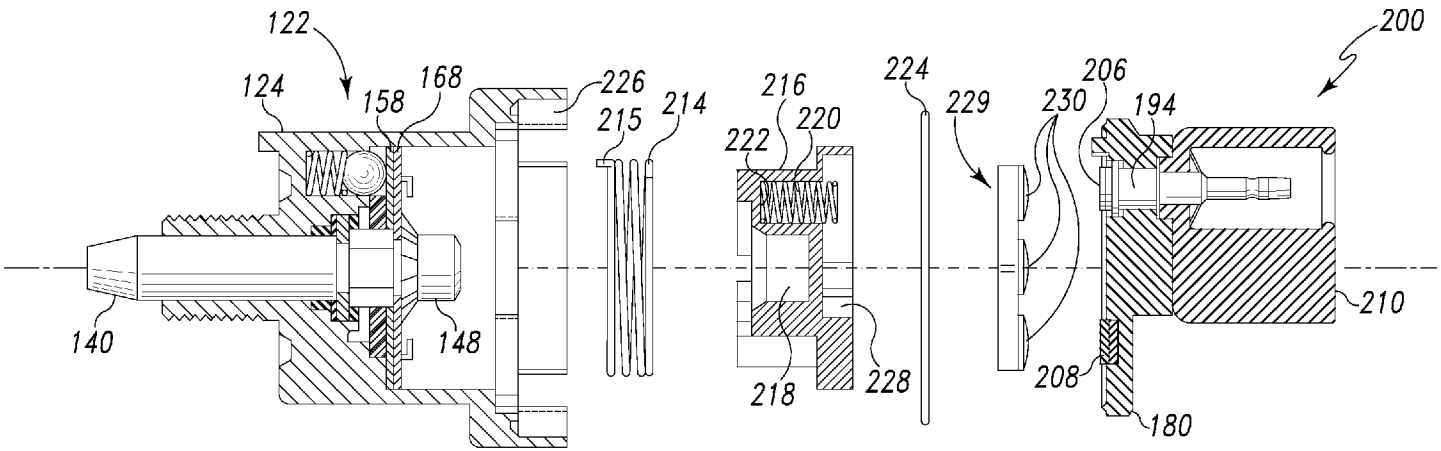
FIG. 5 is an exploded view of the overall assembly of the ignition switch embodiment of FIGS. 2-4.
Figure 5A:
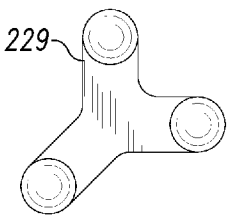
FIG. 5A is a plan view of a contact assembly 229 used therein.
Figure 6:
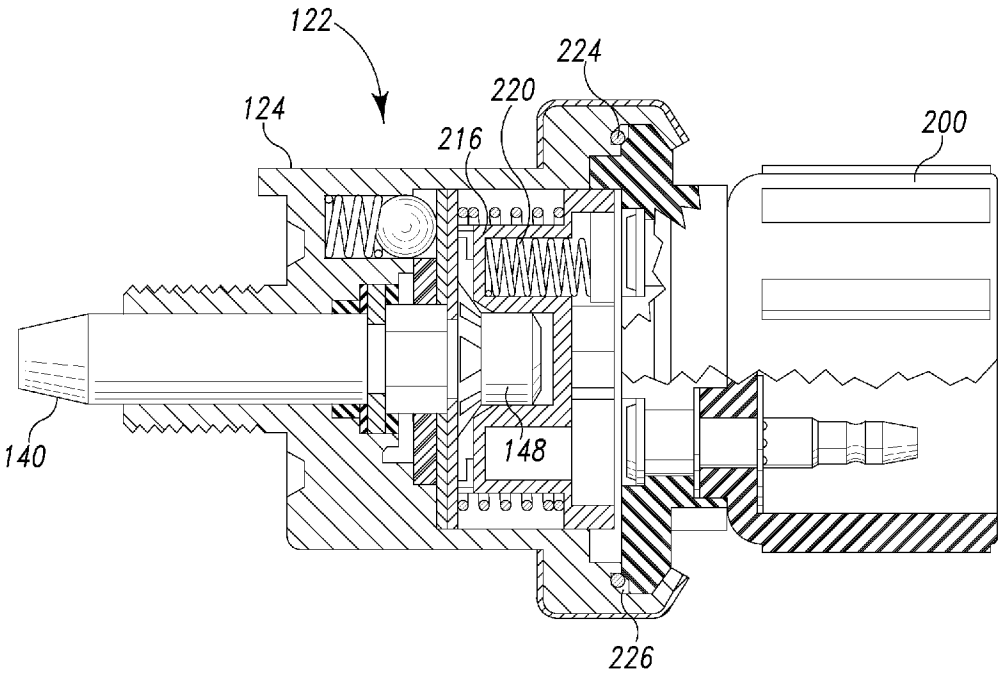
FIG. 6 is a partial section view of an assembled ignition switch according to the embodiment shown in FIGS. 2-5.

Turning now to FIG. 5, spring 214, preferably four coils of either Zinc plating per ASTM B633 FE/ZN5 SC2 type I or cadmium-plated music wire from which the hydrogen embrittlement has been removed, is inserted into the interior of housing 124 adjacent to drive plate 168. End 215 of spring 214 is turned in an axial direction and engages plates 158 and 168 as stem 140 is turned. Insulator 216 (molded polymer, such as Plenco 01581) includes recess 218, which fits over head 148 of stem 140. Springs 220, each being 8.5 turns of inconel nicromate X750 wire with closed ends, fit into each of three recesses 222 in insulator 216. Gasket 224 fits in annular groove 226 of housing 124, and contact assembly 229 (see FIG. 5A) is placed into cavity 228 of insulator 216 into a "Y" area such that each end of contact 229 meets a spring 220. With each of the three contacts 230 facing away from the springs 220, base assembly 200 is fitted over the end into a particular groove in housing 124. While placing base assembly 200 onto assembly 122 to complete the assembly, "Y" contact assembly 229 will be held into place using a suitable tool. The completed assembly is die-pressed into place.

Testing

Tests have been devised to evaluate the durability of systems that conform to the form factor illustrated in FIG. 1, and these have been applied to embodiments of the present invention. One set of tests is for current production quantities and is called the "control test." This battery of tests includes an overload test, an endurance test, a dielectric strength test, a leakage current test, an insulation resistance test, and destructive disassembly and inspection. Each of these procedures will be discussed herein. Additional quantitative test data for certain materials is noted according to the Comparative Tracking Index (CTI) as defined by Underwriters Laboratories Inc.

In the overload test, the switch was energized by a 28.0+/−0.5 VDC source and the switch was exposed to a 75 A resistive load for each switch position through a minimum "on" time of 0.5 seconds with a 10.0+/−1.0 second "off" time repeated for 1000 cycles. Following the specified number of cycles, the load continues to be applied, and the internal voltage drop of the switch is measured between each pair of terminals that is connected in the relevant switch position. The "overload test voltage drop" is defined for purposes of this disclosure to be the greatest of these three measured voltage drops. In 100 tests, the illustrated embodiment has yielded an overload test voltage drop less than or equal to 75 mV in each test.

In the endurance test, the switch was energized by a 28.0+/−0.5 VDC source and was connected to the rated (lamp, resistive, and inductive) loads, and the switch was operated through 12,000 cycles. This test was run in accordance with the following sequence:

Switching from the "off" position to the "run" position, and maintaining the "run" position for 13+/−1 seconds;

Switching to the "start" position and maintaining it for 10+/−1 seconds;

Allowing the switch to move back to the "run" position, and maintaining that position for 60+/−1 seconds; and Switching to the "off" position for a maximum of 60 seconds of cooling time.

Each cycle shall last a total of 145+/−1 seconds.

During this phase of the test, there was no external evidence of malfunction in the illustrated embodiment. After the 12,000 cycles, the terminal-to-terminal voltage was measured for closed switch pairs, and the maximum voltage drop over all of those measurements is defined for the purpose of this disclosure as the "endurance test voltage drop." The endurance test voltage drop in each test of the present embodiment was less than 75 mV. After the endurance test voltage drop test, the operating torque of the switch was not less than 30 ounce-inches.

The dielectric strength test is a variation on U.S. Military Hardware Standard MIL-STD-202G, Method 301, and was performed on a switch that had completed an overload test and a voltage drop test as described above. This test will also be performed after the endurance tests. In each switch position, an AC signal of 1000+/−5 $V_{rms}$ at 60 Hz was applied between non-current-carrying parts. During each position change, the test was performed from terminal to housing and across each pair of terminals. In each position, the voltage between the terminals was checked at a frequency of at least 60 Hz, and the magnitude of the voltage was increased 400 V/s between terminals and between insulated terminal and ground for at least one minute on each application. Leakage current did not exceed 10 mA. Leakage current exceeding 10 mA would have constituted a failure. Switches were examined visually for evidence of damage such as burning, charring, loosening of components, smoking, or cracking, but no such evidence was observed.

The voltage source used for this test was rated to produce at least 0.5 KVA at 1000 VAC. In a series of tests, this voltage was applied between open-circuit contacts, between closed-circuit contacts, and to non-current-carrying parts. Leakage current in each of these situations was measured, and the maximum such current is defined as the "dielectric strength test leakage current." In actual experiments, the dielectric strength test leakage current in the disclosed embodiment did not exceed 10 mA in any test. Further, there was no visible evidence of burning, charring, loosening of components, smoking, or cracking following this test of the disclosed embodiment.

In the leakage current test, the switch was placed in the "off" position, and a potential of 28 VDC was applied between each contact position. Then the switch was put in the "run" position, and the same test potential was applied between the "start" terminal and each of the "off" and "run" terminals. The maximum leakage current in this test is called the "measured leakage current" for purposes of this disclosure. In actual tests, the measured leakage current did not exceed 0.3 mA.

Other tests have been performed on this illustrated embodiment and may also be performed on other embodiments of this switch. For example, a shock test may be performed in accordance with MIL-STD-202G, Method 213B, Test Condition G. A vibration test may be performed in accordance with MIL-STD-202G, Method 201A. A corrosion test may include 240 hours of salt water spray exposure in accordance with MIL-STD-202G, Method 101E, Test Condition D. A fungus resistance test may be performed in accordance with ASTM G21 for a continuous 90-day period. An emersion/pressure test may be performed in accordance with drawing 12480561, as defined for a test of a type 1, class 2 device. A thermal shock emersion test may be performed in accordance with drawing 12480561, as defined for a test of a type 2, class 2 device, including a requirement that the switch remain operational before and after being exposed to thermal shock as specified in section 3.2.2 of that document, except that the test is performed for 10 cycles. A sand and dust test may be performed as outlined in MIL-STD-202G, method 110A, including six hours at 68° F. to 86° F. (20-30° C.), followed by exposure to a temperature of 150° F. to 169° F. (6° C. to 76° C.) for an additional six hours minimum, with sand and dust velocity to the test chamber of between about 1,450 and about 1,950 feet per minute. After each of these tests, the switch according to the described embodiment showed no visible evidence of burning, charring, loosening of components, smoking, or cracking.

After the leakage current test, the disassembly and inspection of the switch was performed destructively and was primarily focused on water ingress and failure of internal insulator and base material. Neither charring, fungus, nor evidence of water ingress was visible.

When versions of an ignition switch that use prior technology were subjected to environments in situations no more severe than the testing described herein, many such switches caught fire, causing serious damage. The insulation material used in those switches was inadequate for further use in military vehicles. Failures would even occur that resulted in vehicles starting while the switches were in the "off" position, or vehicles continuing to run while in the "off" position. Switches were charring on the inside and becoming non-useable.

It has, therefore, been shown that the embodiment illustrated and described herein yields a more reliable ignition switch, and a correspondingly more reliable vehicle. Additional and alternate materials and assembly processes will occur to those skilled in the art in light of the present disclosure as a function of design priorities, including but not limited to cost, durability, environmental concerns, electrical conductivity, and the like.

All publications, prior applications, and other documents cited herein are hereby incorporated by reference in their entirety as if each had been individually incorporated by reference and fully set forth. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An ignition switch for a vehicle, comprising:

a generally cylindrical body having a first end and a second end;

a stem extending from the first end;

a base enclosed within the body; and a plurality of terminals electrically connectable from the second end of the body, the plurality of terminals including a BATTERY terminal, a RUN terminal, and a START terminal;

wherein the base retains the terminals in a substantially fixed relationship to each other, the base interposes insulating material between each pair of terminals and between each terminal and the body, the stem has an OFF position in which no terminals are electrically connected within the switch, an ON position in which the BATTERY terminal and the RUN terminal are electrically connected within the switch, and a START position in which the BATTERY terminal, the RUN terminal, and the START terminal are electrically connected within the switch, while in the START position, the switch is rotationally biased so that it moves automatically to the ON position if no torque is applied to the stem; and the switch having an overload test voltage drop less than about 75 mV when tested by:

energizing the switch with a 28.0 +/−0.5 VDC source between the BATTERY terminal and the body, through 1000 "on"−"off" cycles, applying a 75A resistive load to each switch position through a minimum "on" time of 0.5 seconds and a 10.0 +/−1.0 second "off" time, and after the "on"−"off" cycles, continuing to apply the resistive load and measuring the voltage drop between each pair of terminals that is electrically connected in the OFF, ON, and START switch positions, taking the greatest of these three measurements as the overload test voltage drop.

2. The switch of claim 1 having an endurance test voltage drop less than about 75 mV, where the endurance test voltage drop is measured by:

energizing the switch with a 28.0 +/−0.5 VDC source between the BATTERY terminal and the body, applying a 20 A resistive load on the RUN terminal, a 75 A inductive load to the START terminal, and a 20 A lamp load on either the START or RUN terminal, operating the switch through 12,000 cycles, each comprising:

switching from the OFF position to the RUN position, and maintaining the RUN position for 13 +/−1 seconds;

switching to the START position and maintaining it for 10 +/−1 seconds;

allowing the switch to move back to the RUN position, and maintaining that position for 60 +/−1 seconds; and switching to the "off" position for a maximum of 60 seconds;

so that each cycle lasts 145 +/−1 seconds; and measuring the voltage drop between each pair of terminals that is electrically connected in each of the OFF, ON, and START switch positions, taking the greatest of these three measurements as the endurance test voltage drop.

3. The switch of claim 2 having a dielectric strength test leakage current less than about 10 mA, wherein the dielectric strength test leakage current is measured by:

in each switch position, applying an AC signal of 1000 +/−5 $V_{rms}$ at 60 Hz between non-current-carrying terminals, during each position change, measuring the current from terminal to housing and across each pair of terminals at a frequency of about 60 Hz, and increasing the magnitude of the voltage 400 V/s between terminals and between insulated terminal and ground for about one minute in each switch position, taking the greatest current measurement as the dielectric strength test leakage current.

4. The switch of claim 1, wherein the base is made of a material having a CTI at least about 200.

5. The switch of claim 1, wherein the base is made of a material having a CTI at least about 500.

6. An ignition switch for a vehicle, comprising:

a generally cylindrical body having a first end and a second end;

a stem extending from the first end;

a base enclosed within the body; and a plurality of terminals electrically connectable from the second end of the body, the plurality of terminals including a BATTERY terminal, a RUN terminal, and a START terminal;

wherein the base retains the terminals in a substantially fixed relationship to each other, the base interposes insulating material between each pair of terminals and between each terminal and the body, the stem has an OFF position in which no terminals are electrically connected within the switch, an ON position in which the BATTERY terminal and the RUN terminal are electrically connected within the switch, and a START position in which the BATTERY terminal, the RUN terminal, and the START terminal are electrically connected within the switch, while in the START position, the switch is rotationally biased so that it moves automatically to the ON position if no torque is applied to the stem; and the switch having an endurance test voltage drop less than about 75 mV when the endurance test voltage drop is measured by:

energizing the switch with a 28.0 +/−0.5 VDC source between the BATTERY terminal and the body, applying a 20 A resistive load on the RUN terminal, a 75 A inductive load to the START terminal, and a 20 A lamp load on either the START or RUN terminal, operating the switch through 12,000 cycles, each comprising:

switching from the OFF position to the RUN position, and maintaining the RUN position for 13 +/−1 seconds;

switching to the START position and maintaining it for 10 +/−1 seconds;

allowing the switch to move back to the RUN position, and maintaining that position for 60 +/−1 seconds; and switching to the "off" position for a maximum of 60 seconds;

so that each cycle lasts 145 +/−1 seconds; and measuring the voltage drop between the pairs of terminals that is electrically connected in each of the OFF, ON, and START switch positions, taking the greatest of these measurements as the endurance test voltage drop.

7. The switch of claim 6 having a dielectric strength test leakage current less than about 10 mA, wherein the dielectric strength test leakage current is measured by:

in each switch position, applying an AC signal of 1000 +/−5 $V_{rms}$ at 60 Hz between non-current-carrying terminals, during each position change, measuring the current from terminal to housing and across each pair of terminals at a frequency of about 60 Hz, and increasing the magnitude of the voltage 400 V/s between terminals and between insulated terminal and ground for about one minute in each switch position, taking the greatest current measurement as the dielectric strength test leakage current.

8. The switch of claim 6 having a leakage current less than about 0.3 mA, where the leakage current is measured by:

putting the switch in the OFF position;

applying 28 VDC and measuring the leakage current between each pair of terminals;

moving the switch to the RUN position;

applying 28 VDC and measuring the leakage current between the START terminal and each of the BATTERY and RUN terminals; and taking the maximum of the measurements as the measured leakage current.

9. The switch of claim 6, wherein the base is made of a material having a CTI at least about 200.

10. The switch of claim 6, wherein the base is made of a material having a CTI at least about 500.

11. An ignition switch for a vehicle, comprising:

a generally cylindrical body having a first end and a second end;

a stem extending from the first end;

a base enclosed within the body; and a plurality of terminals electrically connectable from the second end of the body, the plurality of terminals including a BATTERY terminal, a RUN terminal, and a START terminal;

wherein the base retains the terminals in a substantially fixed relationship to each other, the base interposes insulating material between each pair of terminals and between each terminal and the body, the stem has an OFF position in which no terminals are electrically connected within the switch, an ON position in which the BATTERY terminal and the RUN terminal are electrically connected within the switch, and a START position in which the BATTERY terminal, the RUN terminal, and the START terminal are electrically connected within the switch, while in the START position, the switch is rotationally biased so that it moves automatically to the ON position if no torque is applied to the stem; and the switch having a dielectric strength test leakage current less than about 10 mA, wherein the dielectric strength test leakage current is measured by:

in each switch position, applying an AC signal of 1000 +/−5 $V_{rms}$ at 60 Hz between non-current-carrying terminals, during each position change, measuring the current from terminal to housing and across each pair of terminals at a frequency of about 60 Hz, and increasing the magnitude of the voltage 400 V/s between terminals and between insulated terminal and ground for about one minute in each switch position, taking the greatest current measurement as the dielectric strength test leakage current.

12. The switch of claim 11, wherein the base is made of a material having a CTI at least about 200.

13. The switch of claim 11, wherein the base is made of a material having a CTI at least about 500.

14. An ignition switch for a vehicle, comprising:

a generally cylindrical body having a first end and a second end;

a stem extending from the first end;

a base enclosed within the body; and a plurality of terminals electrically connectable from the second end of the body, the plurality of terminals including a BATTERY terminal, a RUN terminal, and a START terminal;

wherein the base retains the terminals in a substantially fixed relationship to each other, the base interposes insulating material between each pair of terminals and between each terminal and the body, the stem has an OFF position in which no terminals are electrically connected within the switch, an ON position in which the BATTERY terminal and the RUN terminal are electrically connected within the switch, and a START position in which the BATTERY terminal, the RUN terminal, and the START terminal are electrically connected within the switch, while in the START position, the switch is rotationally biased so that it moves automatically to the ON position if no torque is applied to the stem; and when the stem is in the OFF position and energized with 28.0 VDC between the BATTERY terminal and the RUN terminal, the current that flows between them is less than about 0.3 mA.

15. The switch of claim 14 having a dielectric strength test current less than about 10 mA, wherein the dielectric strength test leakage current is measured by:

in each switch position, applying an AC signal of 1000 +/−5 Vrms at 60 Hz between non-current-carrying terminals, during each position change, measuring the current from terminal to housing and across each pair of terminals at a frequency of about 60 Hz, and increasing the magnitude of the voltage 400 V/s between terminals and between insulated terminal and ground for about one minute in each switch position, taking the greatest current measurement as the dielectric strength test leakage current.

16. The switch of claim 14, wherein the base is made of a material having a CTI at least about 200.

17. The switch of claim 14, wherein the base is made of a material having a CTI at least about 500.

* * * * *